US010550617B2

(12) United States Patent
Ju

(10) Patent No.: US 10,550,617 B2
(45) Date of Patent: Feb. 4, 2020

(54) SELF-CLOSING HINGE

(71) Applicant: Leeco Technologies Corporation, Taipei (TW)

(72) Inventor: Danny Ju, Taipei (TW)

(73) Assignee: LEECO TECHNOLOGIES CORPORATION, Taipei (TW)

( * ) Notice: Subject to any disclaimer, the term of this patent is extended or adjusted under 35 U.S.C. 154(b) by 0 days.

(21) Appl. No.: 16/238,954

(22) Filed: Jan. 3, 2019

(65) Prior Publication Data

US 2019/0211599 A1 Jul. 11, 2019

Related U.S. Application Data

(60) Provisional application No. 62/614,129, filed on Jan. 5, 2018.

(51) Int. Cl.

| | |
|---|---|
| ***E05D 11/08*** | (2006.01) |
| ***E05D 3/12*** | (2006.01) |
| ***E05D 11/00*** | (2006.01) |
| ***E05D 11/10*** | (2006.01) |
| ***E05F 1/00*** | (2006.01) |

(52) U.S. Cl.

CPC ..... *E05D 11/082* (2013.01); *E05D 3/12* (2013.01); *E05D 11/0054* (2013.01); *E05D 11/1028* (2013.01); *E05F 1/002* (2013.01); *E05Y 2201/10* (2013.01); *E05Y 2201/218* (2013.01); *E05Y 2201/238* (2013.01); *E05Y 2201/26* (2013.01); *E05Y 2900/606* (2013.01)

(58) Field of Classification Search

CPC ..... G06F 1/1681; G06F 1/1616; E05Y 2900/606; E05Y 2201/26; H04M 1/0216; E05D 11/082; E05D 11/084; E05D 11/085; E05D 3/02; E05D 5/14; E05D 2005/145; F16C 11/04

See application file for complete search history.

(56) References Cited

U.S. PATENT DOCUMENTS

| | | | | |
|---|---|---|---|---|
| 5,491,874 A * | 2/1996 | Lowry | G06F 1/1616 | 16/337 |
| 5,566,048 A * | 10/1996 | Esterberg | G06F 1/1616 | 16/307 |
| 5,943,738 A * | 8/1999 | Karfiol | E05D 11/082 | 16/342 |
| 6,230,365 B1 * | 5/2001 | Lu | G06F 1/1616 | 16/16 |

(Continued)

*Primary Examiner* — Chuck Y Mah

(74) *Attorney, Agent, or Firm* — Panitch Schwarze Belisario & Nadel LLP

(57) ABSTRACT

A self-closing hinge has a housing shaft section with a bore extending therethrough in a direction substantially parallel to a longitudinal axis is attachable to a first rotatable member. A bore extends through the housing shaft section. The cross-sectional profile of the bore in a plane orthogonal to the longitudinal axis has at least one arcuate portion and at least one non-arcuate portion. A roll pin rotatably disposed in the bore has substantially the same cross-sectional profile as the bore. A pair of shaft members, each having a shaft-member body attachable to a second rotatable member, has a pin inserted in an interference fit in the opposed ends of the roll-pin bore. The pins have a cross-sectional profile corresponding to the roll-pin cross-sectional profile.

9 Claims, 6 Drawing Sheets

(56) References Cited

U.S. PATENT DOCUMENTS

| | | | | |
|---|---|---|---|---|
| 7,500,288 | B2 * | 3/2009 | Chung | E05D 11/082 16/342 |
| 7,549,193 | B2 * | 6/2009 | Lee | G06F 1/1616 16/342 |
| 2002/0162191 | A1 * | 11/2002 | Chen | G06F 1/1616 16/337 |
| 2005/0034274 | A1 * | 2/2005 | Wu | G06F 1/1616 16/342 |
| 2005/0102796 | A1 * | 5/2005 | Lee | G06F 1/1601 16/342 |
| 2011/0239408 | A1 * | 10/2011 | Chang | G06F 1/1681 16/386 |
| 2012/0204380 | A1 * | 8/2012 | Chen | E05D 11/082 16/342 |
| 2014/0059805 | A1 * | 3/2014 | Krahn | G06F 1/1681 16/342 |
| 2018/0038143 | A1 * | 2/2018 | Novin | E05D 5/14 |

* cited by examiner

SELF-CLOSING HINGE

CROSS-REFERENCE TO RELATED APPLICATIONS

This application claims the benefit of U.S. Provisional Patent Application No. 62/614,129, filed Jan. 5, 2018, the disclosure of which is incorporated herein by reference.

BACKGROUND OF THE INVENTION

The present invention relates to a self-closing hinge, particularly to a spring-less structure that accomplishes automatic closing with small angle movement.

Many electronic products available in the market today, such as laptops, mobile phones, translation machines, PDAs (personal digital assistants) and the like; generally have a main body and a screen or lid that can be hinged or rotated by a certain angle relative to the main body. Traditional mechanical hinges require the user to manually open and close the device through the full range of motion. Other hinges have attempted to provide for automatic closing of screens or lids through use of torsion springs which resist the opening of the hinge and force the door shut. However, such springs have a limited lifetime and operate over the entire range of angular movement, thereby prohibiting the screen or lid from remaining open at a fixed location.

Accordingly, there is a need for an improved hinge structure which overcomes the aforementioned shortcomings in the prior art by providing automatic closing of the screen or lid at small angles while still allowing the hinge to remain open at discrete angles therebetween.

BRIEF SUMMARY OF THE INVENTION

Briefly stated, one embodiment of the present invention is directed to a self-closing hinge for pivotably connecting a first rotatable member to a second rotatable member. The self-closing hinge has a housing comprising a housing shaft section having a longitudinal axis. The housing shaft section is attachable to the first rotatable member. A housing shaft-section bore extends through the housing shaft section in a direction substantially parallel to the longitudinal axis. The housing shaft-section bore has a housing shaft-section bore cross-sectional profile in a plane orthogonal to the longitudinal axis. The housing shaft-section bore cross-sectional profile has at least one arcuate housing shaft-section bore portion and at least one non-arcuate housing shaft-section bore portion. A roll pin is rotatably disposed in the housing shaft-section bore. The roll pin has a roll-pin bore extending through the roll pin in the direction substantially parallel to the longitudinal axis. The roll pin has a roll-pin cross-sectional profile in the plane orthogonal to the longitudinal axis. The roll-pin cross-sectional profile has at least one arcuate roll-pin portion and at least one non-arcuate roll-pin portion. A pair of shaft members is provided. Each shaft member of the pair of shaft members has a shaft-member body attachable to the second rotatable member. A shaft-member pin extends from the shaft-member body and has a shaft-member pin cross-sectional profile corresponding to the roll-pin cross-sectional profile. The shaft member pin of one shaft member of the pair of shaft members is inserted in an interference fit in a first end of the roll-pin bore and the shaft member pin of the other shaft member of the pair of shaft members is inserted in an interference fit in a second end of the roll-pin bore.

BRIEF DESCRIPTION OF THE SEVERAL VIEWS OF THE DRAWINGS

The detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
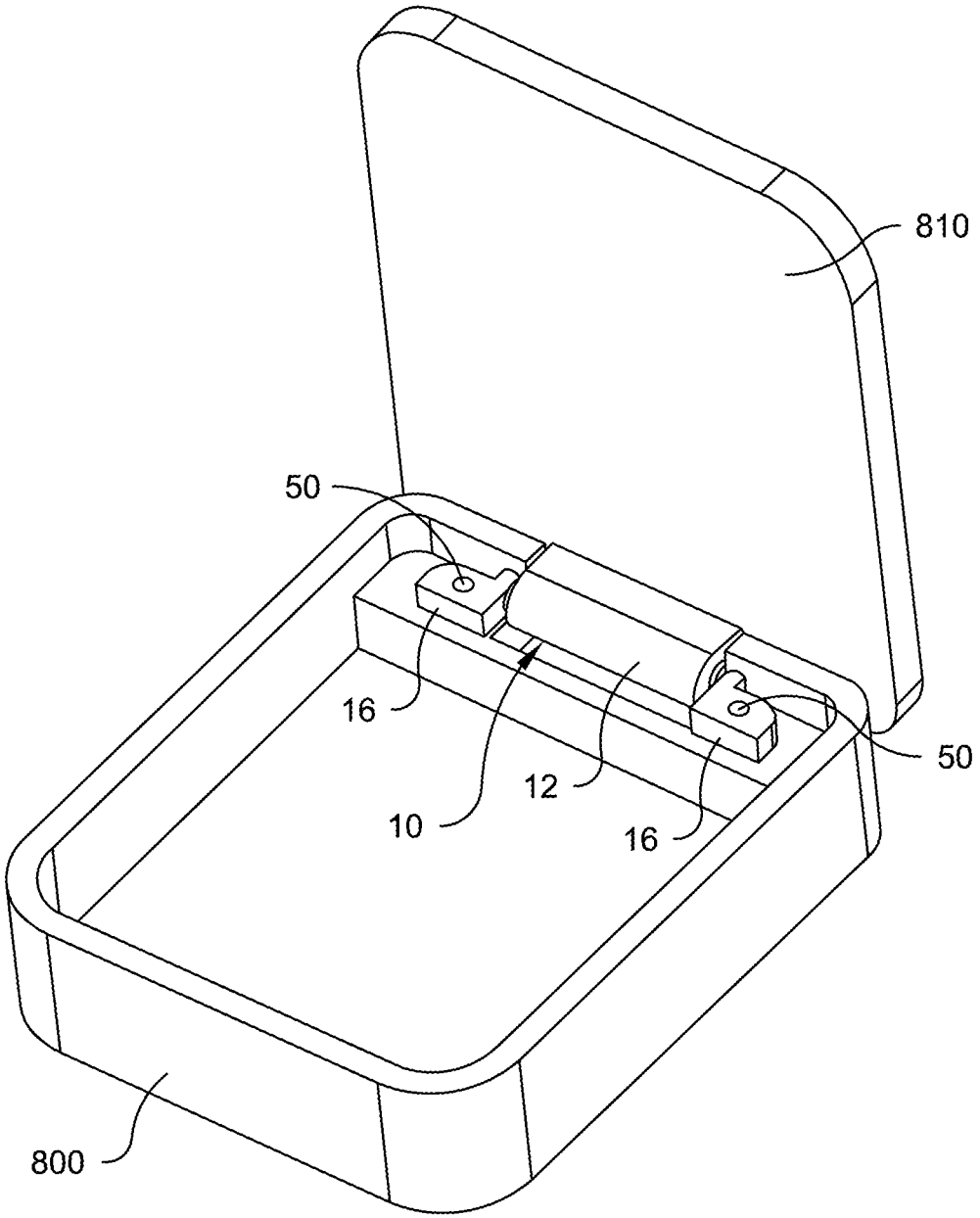
FIG. 1 is a front and top perspective of a preferred embodiment of the self-closing hinge according to the present invention shown attached to a base and a lid.
Figure 2:
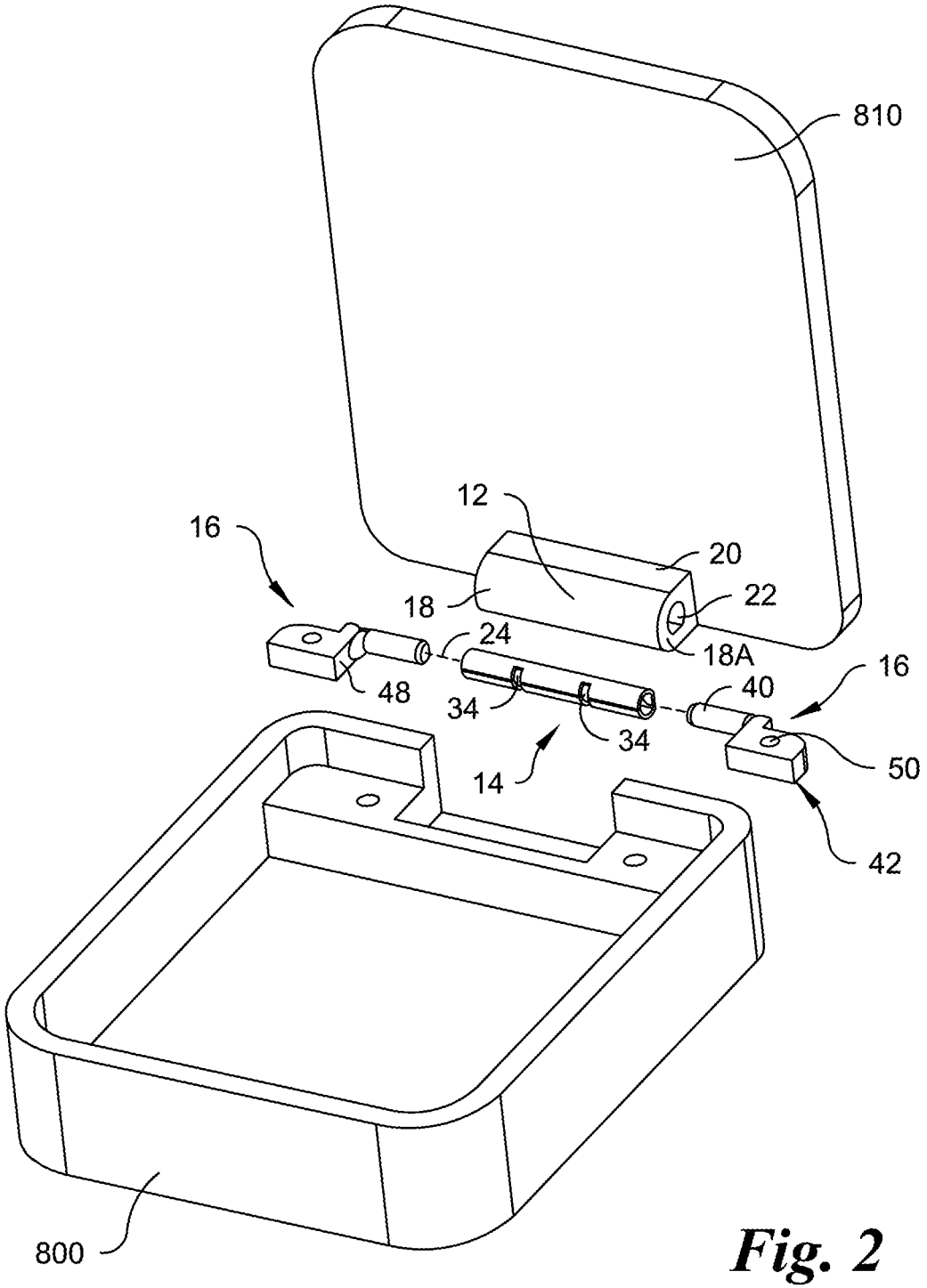
FIG. 2 is an exploded front and top perspective view of the self-closing hinge as shown in FIG. 1.
Figure 3:
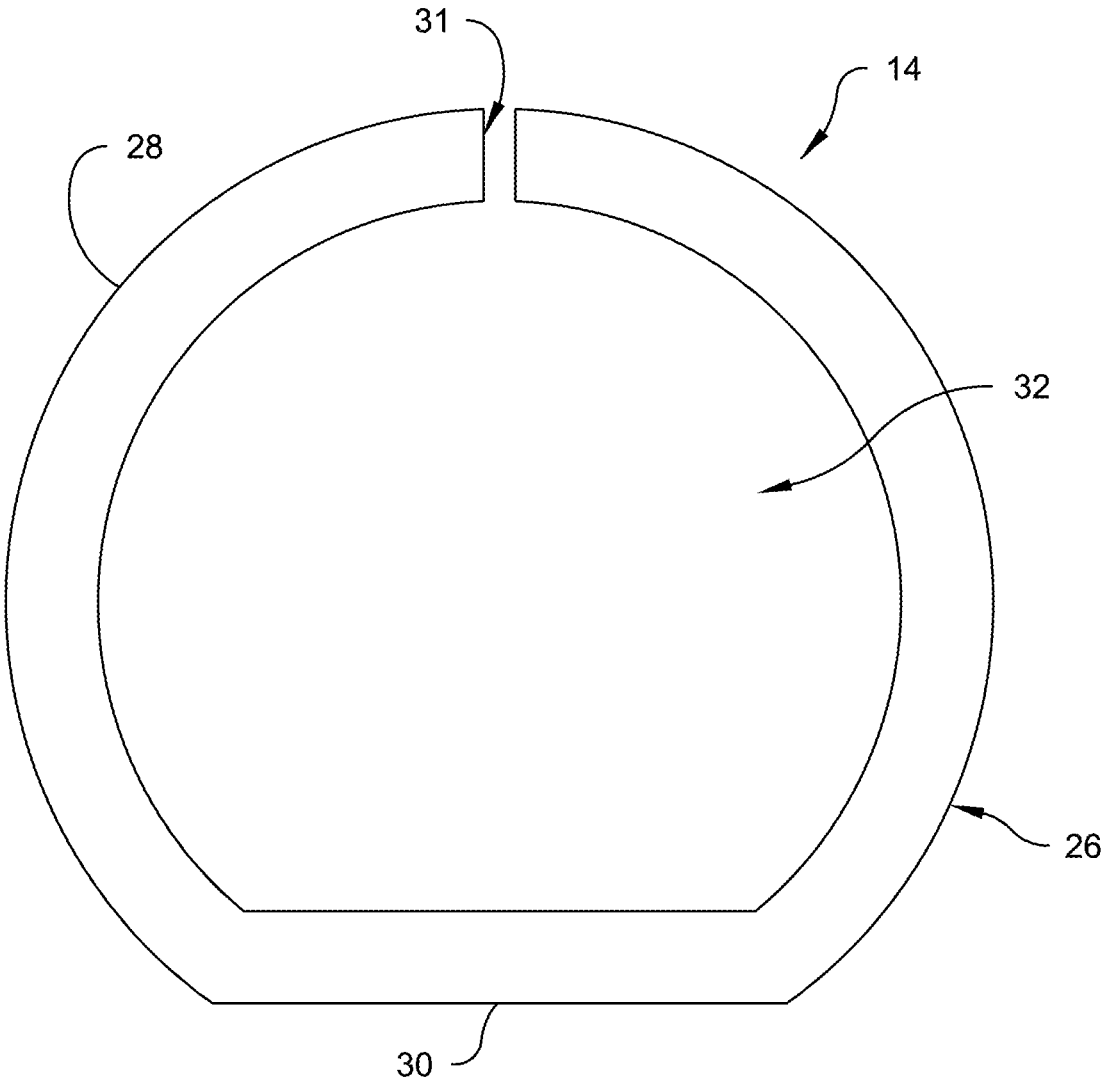
FIG. 3 is a greatly enlarged right side elevational view of a roll pin of the self-closing hinge as shown in FIG. 1.

Reference will now be made in detail to an embodiment of the invention, examples of which are illustrated in the accompanying drawings. The terminology used in the description of the invention herein is for the purpose of describing the particular embodiment only and is not intended to be limiting of the invention.

As used in the description of the invention, the singular forms "a", "an" and "the" are intended to include the plural forms as well, unless the context clearly indicates otherwise. The words "and/or" as used herein refers to and encompasses any and all possible combinations of one or more of the associated listed items. The words "comprises" and/or "comprising," when used in this specification, specify the presence of the stated features, integers, operations, elements, and/or components, but do not preclude the presence of addition of one or more other features, integers, steps, operations, elements, components, and/or groups thereof.

It should also be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

The words "right," left," "lower," "upper," "front" and "rear" designate directions in the drawings to which reference is made. The words "inwardly" and "outwardly" refer to directions toward and away from, respectively, the geometric center of the hinge, and designated parts thereof. The terminology includes the words noted above, derivatives thereof and words of similar import.

Although the words first, second, etc., are used herein to describe various elements, these elements should not be limited by these words. These words are only used to distinguish one element from another. For example, a first rotatable member could be termed a second rotatable member without departing from the scope of the present invention.

Referring to the drawings in detail, where like numerals indicate like elements throughout, there is shown in FIGS. 1-6 a first preferred embodiment of a self-closing hinge, generally designated 10, and hereinafter referred to as the "hinge" 10 in accordance with the present invention. The hinge 10 may be used to pivotably connect a first rotatable member 810 to a second rotatable member 800 rotatable relative to the first rotatable member 810.

The hinge 10 comprises a housing 12, a roll pin 14, and a pair of shaft members 16. The housing 12 comprises a housing shaft section 18 and a housing support section 20 fixedly attached to or integral with the housing shaft section 18. Preferably, the housing shaft section 18 may be generally cylindrical in shape though it will be understood that any shape that facilitates rotation about a longitudinal axis 24 could be used. In a preferred embodiment, the housing support section 20 and the housing shaft section 18 may be integrally formed as one part. The housing support section 20 may be configured to be attached to the first rotatable member 810, such as a lid, door, screen 810 or the like, for which the hinge 10 acts as a pivot. The housing support section 20 is attached or otherwise secured to the first rotatable member 810 by screws, bolts, an adhesive, nails, or the like which are well known in the art or, alternatively, the housing support section 20 may be integrally formed with the first rotatable member 810.

The housing shaft section 18 further comprises a housing-shaft-section bore 22 extending through the housing shaft section 18 in the direction of the longitudinal axis 24 and substantially parallel therewith. The housing shaft-section bore 22 has a housing shaft-section bore cross-sectional profile 23 in a plane orthogonal to the longitudinal axis 24. In some embodiments, the housing shaft-section bore cross-sectional profile 23 may have at least one arcuate housing shaft-section bore portion 23*a* and at least one non-arcuate housing shaft-section bore portion 23*b*. In other embodiments, the housing shaft-section bore cross-sectional profile 23 may be D-shaped. Alternatively, the housing shaft-section bore cross-sectional profile 23 may be circular or any other suitable shape. The housing 12 is preferably made of a metallic material, but could be made from a polymeric or any other suitable material known in the art.

Figure 4:
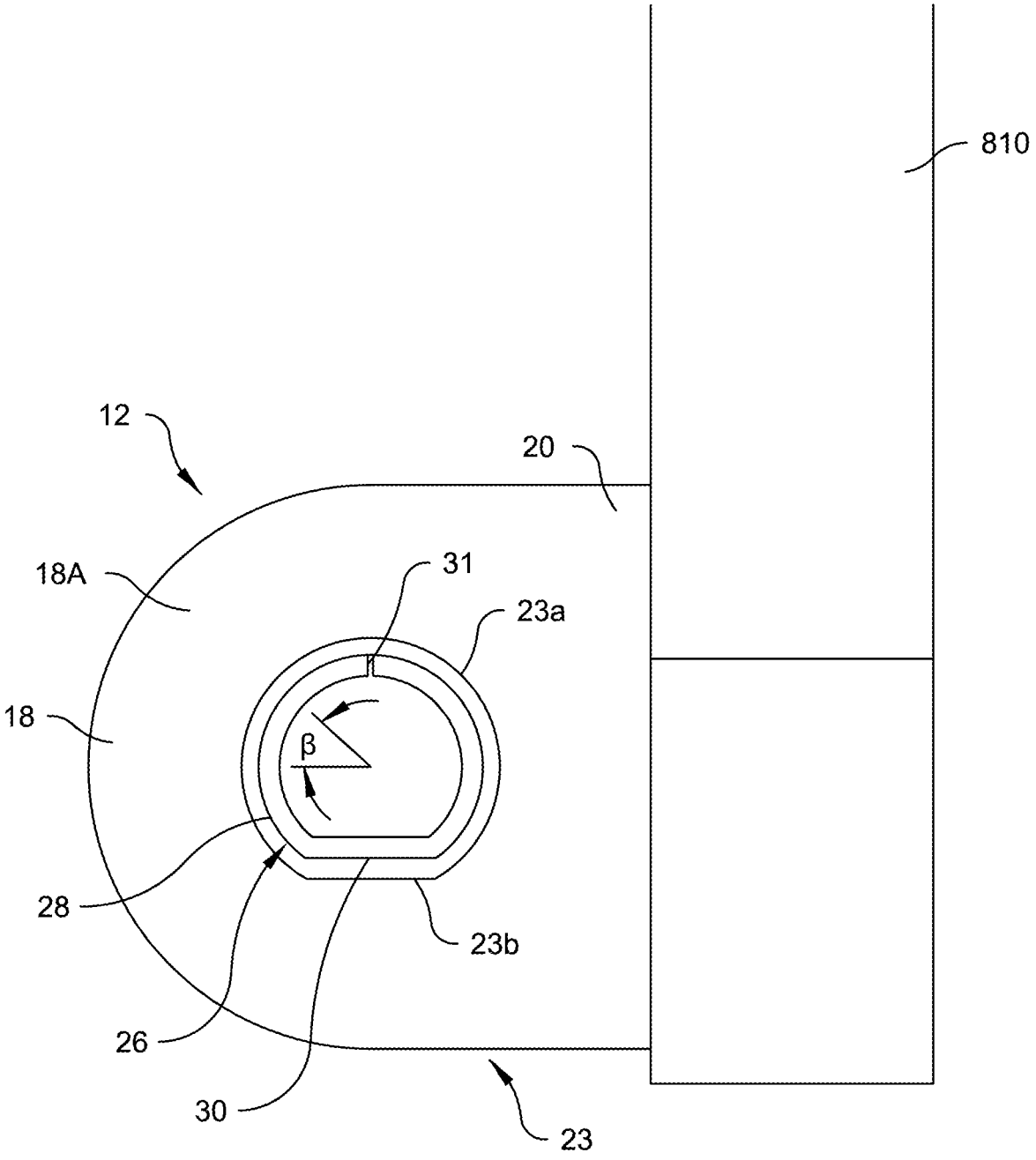
FIG. 4 is a greatly enlarged fragmentary right side elevational view of a bore of a housing of a portion of the self-closing hinge as shown in FIG. 1.
Figure 5:
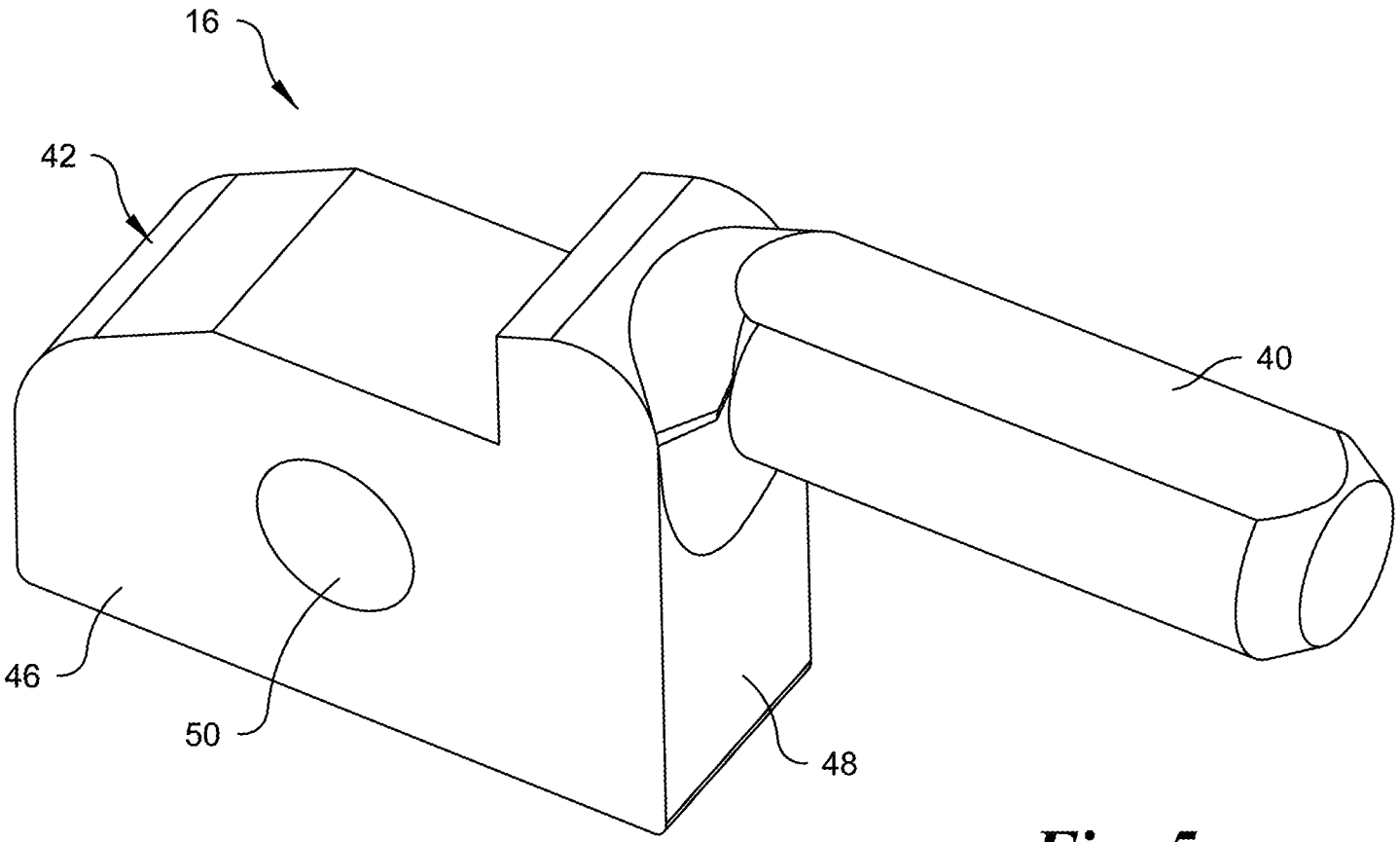
FIG. 5 is a greatly enlarged rear and top perspective view of a shaft member of the self-closing hinge as shown in FIG. 1.
Figure 6:
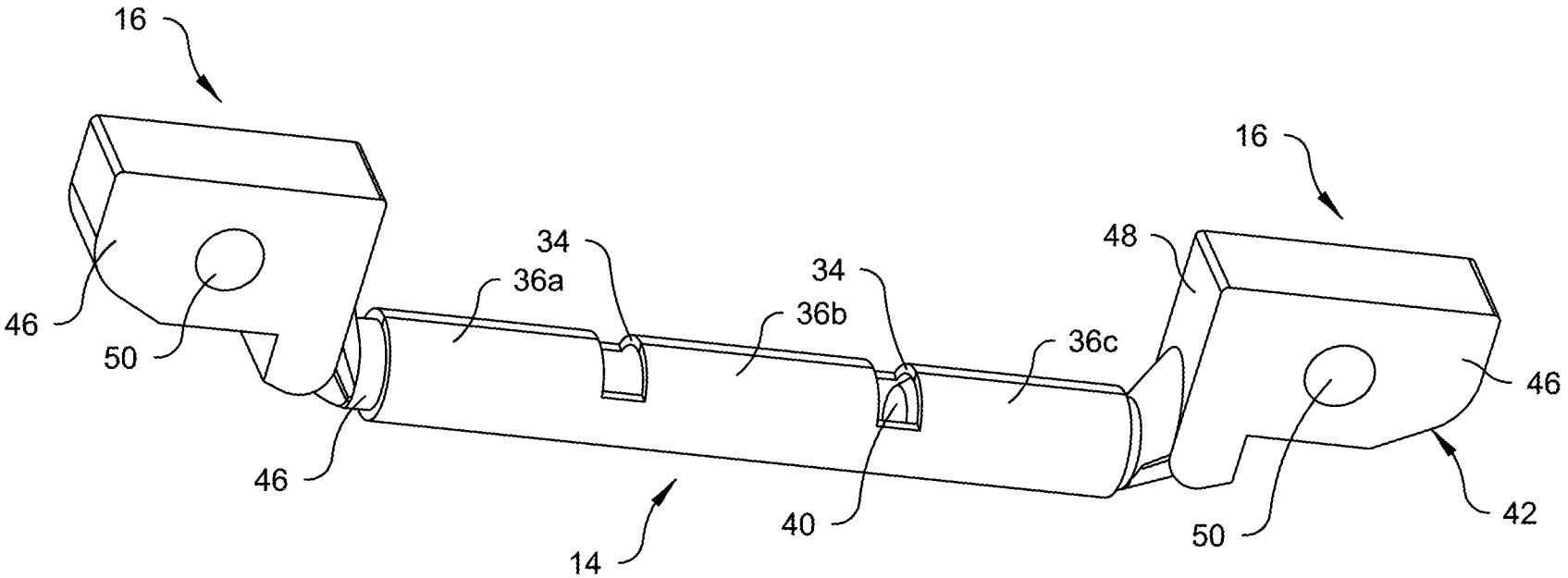
FIG. 6 is a greatly enlarged front and top perspective view of a roll pin and shaft members of the self-closing hinge as shown in FIG. 1.

The roll pin 14 is configured to be slidably inserted into the housing-shaft-section bore 22, as can be seen in FIG. 4, such that roll pin 14 is completely disposed in the housing-shaft-section bore 22. The roll pin 14 further comprises a roll-pin cross-sectional profile 26, lying in a plane orthogonal to the longitudinal axis 24, which is comprised of at least one roll-pin cross-sectional profile arcuate portion 28 and at least one roll-pin cross-sectional profile non-arcuate portion 30 (see FIG. 3). An outer dimension of the roll pin 14 is at least slightly smaller than an inner dimension of the housing-shaft-section bore 22. In a preferred embodiment, the roll-pin profile 26 is also preferably D-shaped. The roll pin 14 further includes a roll-pin slit 31 (see FIG. 3), extending along the entire length substantially parallel to the longitudinal axis 24. The roll-pin slit 31 is disposed in the arcuate portion 28 of the roll-pin profile 26, generally opposite of the non-arcuate portion 30. The roll-pin slit 31 facilitates expansion of the roll pin 14 when the shaft members 16 are inserted, as discussed in more detail below. The roll pin 14 further comprises a roll-pin bore 32 (see FIG. 3) extending throughout the length of the roll pin 14 in the direction of the longitudinal axis 24 and substantially parallel therewith. The roll pin 14 also comprises a pair of roll-pin slots 34 cut into the arcuate portion 28 of the roll-pin profile 26 orthogonal to the longitudinal axis 24 and at predetermined lengths along the roll pin 14. The roll-pin slots 34 extend at least partially from the top of the roll pin 14 toward the bottom. The roll-pin slots 34 define three distinct contiguous regions 36*a*, 36*b*, 36*c* on the roll pin 14. In a preferred embodiment, the distinct region 36*b* of the roll pin 14 may be crimped in the housing-shaft-section bore 22. When the roll pin 14 is fully inserted into the housing-shaft-section bore 22, the housing shaft section 18 of the housing 12 may be crimped utilizing a crimping or clamping tool which engages the housing 12. The crimping of the roll pin 14 translationally and rotationally secures the roll pin 14 into the housing-shaft-section bore 22. In an alternative embodiment, the housing 12 may include an indent (not shown) on the housing shaft section 18. The indent facilitates crimping of the roll pin 14 within the housing-shaft-section bore 22.

The hinge 10 further comprises a pair of shaft members 16. Each shaft member 16 comprises a shaft-member pin 40 and a shaft-member body 42. The shaft-member pin 40 extends outwardly away from the shaft-member body 42 in a direction parallel with the longitudinal axis 24. The shaft-member pin 40 further has a profile that matches the roll-pin profile 26, with an outer dimension of the shaft-member pin 40 being at least slightly larger than an inner dimension of the roll pin 14, such that, when assembled together, the shaft member 16 and roll pin 14 are in an interference fit. The shaft-member pin 40 is configured to be slidably inserted into the roll-pin bore 32 of the roll pin 14. The shaft-member pin 40 extends inwardly from the end of the roll pin 14 a distance slightly less than an outer edge of the roll-pin slots 34 (see FIG. 6). When the shaft-member pin 40 of the shaft member 16 is inserted into the roll-pin bore 32 of the roll pin 14, the roll-pin slit 31 of the roll pin 14 allows the roll pin 14 to accommodate the larger dimension of the shaft-member pin 40.

The shaft-member body 42 of the shaft member 16 includes a shaft-member-body mating surface 48 which engages a sidewall 18A of the housing shaft section 18 of the housing 12 when the shaft-member pin 40 is fully inserted into the roll pin 14, as illustrated by FIG. 4. The shaft-member body 42 further comprises an shaft-member body attachment section 46 which lies in a plane generally orthogonal to the shaft-member-body mating surface 48 and extends in a direction opposite that of the shaft-member pin 40. The shaft-member body attachment section 46 further comprises one or more holes 50, and preferably one, extending completely through the shaft-member body attachment section 46. The holes 50 are configured to receive screws, nails, pins, bolts, fasteners or the like, as is well known in the art, for affixing the hinge 10 to a surface of a base 800. The pair of shaft members 16 is preferably made of a metallic material, but could be made from any suitable material known in the art.

The housing 12 and roll pin 14 are capable of rotating about the shaft pins 16 at a rotation angle β. As rotation angle β approaches small angles relative to horizontal, the roll-pin profile 26 allows for a "snapping" function to occur, namely the friction and torque caused by rotation of the housing 12 and roll pin 14 relative to the shaft member 16 forces the hinge closed. The "snapping" function occurs when the rotation angle β ranges from about zero degrees to about fifteen degrees, namely when the bottom of the shaft pin 16 approaches the non-arcuate portion 30 of the roll pin 14.

The hinge 10 is assembled by inserting the roll pin 14 into the shaft section 18 of the housing 12 and then crimping the housing 12 and roll pin 14 together at distinct region 36*b*. The shaft members 16 are then inserted into each end of the roll pin 14, such that each mating surface 48 is in contact with the sidewall 18*a* of the shaft section 18.

In operation, the self-closing hinge 10 is attached to the second rotatable member (or base) 800 of an electronic product utilizing conventional attachment means engaged through the holes 50 of the shaft members 16. The housing support section 20 is also attached to, or integral with, the first rotatable member (or screen or lid) 810 of the electronic product utilizing conventional attachment means. The user of the electronic product may then open the screen 810 and utilize the device within the base 800. The friction and torque provided by the interference fit of the roll pin 14 and shaft member 16 allows the screen 810 to be held open at the rotation angle β the user chooses, which causes stress in the roll pin 14 due to mismatch of the geometries between the roll pin 14 and the shaft members 16. When the user is finished with the electronic product, the user rotates screen 810 toward the closed position (i.e. when rotation angle β is about 0 degrees). When the rotation angle β is about fifteen degrees from horizontal, the screen 810 automatically snaps shut as the roll pin 14 biases towards a relaxed state. The friction and torque provided by the hinge 10 maintains the screen 810 in a closed position until the user manually opens the screen 810 again.

The foregoing detailed description of the invention has been disclosed with reference to specific embodiments. However, the disclosure is not intended to be exhaustive or to limit the invention to the precise forms disclosed. Those skilled in the art will appreciate that changes could be made to the embodiments described above without departing from the broad inventive concept thereof. Therefore, the disclosure is intended to cover modifications within the spirit and scope of the present invention as defined by the appended claims.

All references, patent applications, and patents mentioned above are incorporated herein by reference in their entirety and are not to be construed as an admission that any of the cited documents constitutes prior art, or as an admission against interest in any manner.

I claim:

1. A self-closing hinge for pivotably connecting a first rotatable member to a second rotatable member, the self-closing hinge comprising:

a housing comprising:

a housing shaft section having a longitudinal axis, the housing shaft section attachable to the first pivotable member; and a housing shaft-section bore extending through the housing shaft section in a direction substantially parallel to the longitudinal axis, the housing shaft-section bore having a housing shaft-section bore cross-sectional profile in a plane orthogonal to the longitudinal axis, the housing shaft-section bore cross-sectional profile having at least one arcuate housing shaft-section bore portion and at least one non-arcuate housing shaft-section bore portion;

a roll pin rotatably disposed in the housing shaft-section bore, the roll pin comprising:

a roll-pin bore extending through the roll pin in the direction substantially parallel to the longitudinal axis, the roll pin having a roll-pin cross-sectional profile in the plane orthogonal to the longitudinal axis, the roll-pin cross-sectional profile having at least one roll-pin cross-sectional profile arcuate portion and at least one roll-pin cross-sectional profile non-arcuate portion; and a pair of shaft members, each shaft member of the pair of shaft members comprising:

a shaft-member body attachable to the second pivotable member; and a shaft-member pin extending from the shaft-member body and having a shaft-member pin cross sectional profile corresponding to the roll-pin cross-sectional profile, wherein the shaft member pin of one shaft member of the pair of shaft members is inserted in an interference fit in a first end of the roll-pin bore and an other shaft member of the pair of shaft members is inserted in an interference fit in a second end of the roll-pin bore.

2. The self-closing hinge according to claim 1, wherein the housing shaft-section bore cross-sectional profile and the roll-pin cross-sectional profile are D-shaped.

3. The self-closing hinge according to claim 1, wherein the roll pin further comprises:

a roll-pin slit extending along the entire length substantially parallel to the longitudinal axis, the roll-pin slit being disposed in the at least one arcuate roll-pin portion of the roll-pin cross-sectional profile generally opposite the least one non-arcuate roll-pin portion of the roll-pin cross-sectional profile; and an outer dimension of the shaft-member pin is larger than an inner dimension of the roll pin, wherein the roll-pin slit facilitates expansion of the roll pin when the shaft members are inserted in the roll-pin bore.

4. The self-closing hinge according to claim 1, wherein the roll pin further comprises:

a pair of roll-pin slots cut into the at least one arcuate roll-pin portion of the roll-pin cross-sectional profile orthogonal to the longitudinal axis and at predetermined lengths along the roll pin, and the roll-pin slots define three distinct contiguous roll-pin regions on the roll pin, wherein crimping the housing shaft section and the roll pin together at the roll-pin slots defining a central region of the three distinct roll-pin regions translationally and rotationally secures the roll pin in the housing shaft-section bore.

5. The self-closing hinge according to claim 1, wherein the shaft-member body of each shaft member has a mating surface which engages a sidewall of the housing shaft section of the housing when the shaft-member pin is fully inserted into the roll pin.

6. The self-closing hinge according to claim 5, wherein the body of the shaft member further comprises an attachment section which lies in a plane generally orthogonal to the mating surface and extends in a direction opposite that of the shaft pin, the attachment section attachable to a second rotatable member by at least one fastener.

7. The self-closing hinge according to claim 1, wherein a friction and a torque provided by the interference fit of the roll pin and the shaft member allows the first rotatable member to be rotated relative to the second rotatable member and releasably retained at a rotational angle within a predetermined range of angles.

8. The self-closing hinge according to claim 7, wherein the predetermined range of angles is between zero degrees and one-hundred eighty degrees.

9. The self-closing hinge according to claim 7, wherein an audible signal is produced when the rotational angle ranges from about zero degrees to about fifteen degrees.

* * * * *